US007047942B2

(12) United States Patent
Ando et al.

(10) Patent No.: US 7,047,942 B2
(45) Date of Patent: May 23, 2006

(54) PIPING STRUCTURE OF FUEL INJECTION PIPES FOR ENGINE

(75) Inventors: Hatsuo Ando, Oyama (JP); Tatsuya Iwazaki, Oyama (JP); Kanji Namimatsu, Oyama (JP); Takumi Ito, Oyama (JP); Yasuyuki Onodera, Oyama (JP)

(73) Assignee: Komatsu Ltd., Tokyo (JP)

( * ) Notice: Subject to any disclaimer, the term of this patent is extended or adjusted under 35 U.S.C. 154(b) by 14 days.

(21) Appl. No.: 10/806,328

(22) Filed: Mar. 23, 2004

(65) Prior Publication Data

US 2004/0194761 A1 Oct. 7, 2004

(30) Foreign Application Priority Data

Apr. 4, 2003 (JP) ..... 2003-101452

(51) Int. Cl.
*F02M 55/00* (2006.01)

(52) U.S. Cl. ..... 123/468; 123/469; 123/456

(58) Field of Classification Search ..... 123/456, 123/468, 469, 470
See application file for complete search history.

(56) References Cited

U.S. PATENT DOCUMENTS

| | | | | |
|---|---|---|---|---|
| 1,966,032 | A * | 7/1934 | Hasbrouck | 123/456 |
| 2,818,840 | A * | 1/1958 | McGowen | 123/41.31 |
| 2,892,453 | A * | 6/1959 | Stoll | 123/452 |
| 3,194,221 | A * | 7/1965 | Dinger et al. | 123/193.5 |
| 4,192,267 | A * | 3/1980 | Cobb | 123/568.3 |
| 5,697,344 | A * | 12/1997 | Ikari | 123/468 |
| 6,138,641 | A * | 10/2000 | Moser | 123/456 |

FOREIGN PATENT DOCUMENTS

JP 2797745 7/1998

* cited by examiner

*Primary Examiner*—Thomas Moulis
(74) *Attorney, Agent, or Firm*—Wenderoth, Lind & Ponack, L.L.P.

(57) ABSTRACT

Cylinder heads (100*a* to 100*f* are respectively provided with fuel injectors (101*a* to 101*f*). Each of the fuel injectors (101*a to* 101*f*) is connected to each of joints (105*a* to 105*f*) in a common rail (105) extending linearly through fuel injection pipes (103*a* to 103*f*). In this example, it can be achieved to allow all the fuel injection pipes (103*a* to 103*f*) to have the same length by crossing the injection pipes (103*b*, 103*c*, 103*d* and 103*e*) to connect. With this configuration, it is possible to reduce the irregularities in the amount of fuel injection and to enhance the engine performance.

14 Claims, 7 Drawing Sheets

PIPING STRUCTURE OF FUEL INJECTION PIPES FOR ENGINE

BACKGROUND OF THE INVENTION

1. Field of the Invention

The present invention relates to a piping structure of fuel injection pipes applied to a diesel engine and the like. More particularly, the invention relates to a piping structure of fuel injection pipes for an engine having such advantages that irregularities in the amount of fuel injection are reduced to enhance engine performance, or productivity and reliability of the piping structure can be enhanced.

2. Description of the Related Art

Japanese Patent No. 2797745 (patent document 1) can be given as one example of known arts with respect to a fuel injection device of an internal combustion engine.

FIG. 7 is a plan view of the fuel injection device disclosed in the patent document 1. A diesel engine shown in FIG. 7 includes six cylinders, and each of fuel injectors (injection valves) 1*a* to 1*f* is provided with each of the cylinders. Each of the fuel injectors 1*a* to 1*f* is connected to a fuel accumulator 22 via injection pipes 21*a* to 21*f* respectively corresponding thereto. The fuel accumulator 22 is formed in a common rail 53 which extends linearly. Fuel exits 22*a* to 22*f* are provided in the fuel accumulator 22 in the common rail 53.

A fuel pump 2 is connected to the fuel accumulator 22 in the common rail 53. The fuel pump 2 comprises two pumps, i.e., a first fuel pump 2*a* and a second fuel pump 2*b*. The first and second fuel pumps 2*a* and 2*b* are connected to the fuel accumulator 22 via fuel supply pipes 37*a* and 37*b*, respectively corresponding thereto. Fuel is alternately discharged from the first and second fuel pumps 2*a* and 2*b*.

In this fuel injection device, as is apparent in FIG. 7, the fuel injectors 1*a* to 1*f* are sequentially, from one end to the other, connected to the fuel exits 22*a* to 22*f* via the injection pipes 21*a* to 21*f*, respectively corresponding thereto. That is, the fuel injector 1*a* is connected to the fuel exit 22*a* through the injection pipe 21*a*, and likewise, the valves, exits and pipes are connected in the following manner: the fuel injector 1*b*⇔the injection pipe 21*b*⇔the fuel exit 22*b*, . . . , the fuel injector 1*f*⇔the injection pipe 21*f*⇔the fuel exit 22*f*.

In the example shown in FIG. 7, a fuel introducing position (connecting portion for the fuel supply pipes 37*a* and 37*b*) for the fuel accumulator 22 is set between the fuel exits 22*b* and 22*c*, the fuel exits 22*a* to 22*f* are pitched irregularly, and distance between each of the fuel injectors la to if and each of the fuel exits 22*a* to 22*f* is made shorter to thereby allow each of the injection pipes 21*a* to 21*f* to have the same length. By allowing each of the injection pipes 21*a* to 21*f* to have the same length, the irregularities in the amount of fuel injection are reduced to a low level.

However, with the configuration of the patent document 1 as described above, since the fuel introducing position for the fuel accumulator 22 is set between the fuel exits 22*b* and 22*c*, the fuel supply pipes 37 and 37*b* become long as compared with a case in which, for example, the fuel introducing position is set at an end of the fuel accumulator 22 (a lower section in FIG. 7), and therefore, there is a possibility that reliability is lowered.

Further, with the configuration of the patent document 1, it is necessary to set the positions of the fuel exits 22*a* to 22*f* of the fuel accumulator 22 in accordance with cylinder pitches of the engine and thus, the common rail 53 becomes a specified part for each series of engines. Therefore, some kinds of common rails must be prepared in accordance with shapes and types of the engines, which results in the deterioration of productivity and the increase of production cost.

SUMMARY OF THE INVENTION

The present invention has been accomplished based on the above problems, and it is an object of the invention to provide a piping structure of fuel injection pipes for an engine having such advantages that irregularities in the amount of fuel injection are reduced to enhance engine performance, or productivity and reliability of piping structure can be enhanced.

To solve the above problems, a first piping structure of fuel injection pipes of an engine of the present invention is provided, wherein in a piping structure of fuel injection pipes for an engine, the pipes disposed between fuel injectors (injection nozzles) respectively provided to a plurality of cylinders being disposed in a line and a fuel accumulator (a common rail) which delivers fuel to the fuel injectors, each of the fuel injection pipes is individually connected to each of the fuel injectors of the cylinders, each of the plurality of the fuel injection pipes is individually connected to each of a plurality of fuel exit holes arranged along the longitudinal direction of the common rail and all or some of the plurality of the fuel injection pipes are arranged to be crossed each other.

A second piping structure of fuel injection pipes of an engine of the invention is provided, wherein in a piping structure of fuel injection pipes for an engine, the pipes disposed between fuel injectors respectively provided in a plurality of cylinders being disposed in a line and an in-line pump having a plurality of individual pumps being disposed in a line respectively provided for each of the fuel injectors for pressurizing fuel which is to be delivered to each of the fuel injectors, each of the fuel injection pipes is individually connected to each of the fuel injectors of the cylinders, each of the plurality of the fuel injection pipes is individually connected to the plurality of the individual pumps and all or some of the plurality of the fuel injection pipes are arranged to be crossed each other.

According to the piping structure of the invention, all or some of the plurality of fuel injection pipes are made to be crossed, and thereby it becomes easy to allow the fuel injection pipes to have the same length. Therefore, since the irregularities in the amount of fuel injection can be reduced, the engine performance can be enhanced. Greater effect can be obtained especially when this piping structure is applied to a multi-injection system in which a pilot injection system, a pre-injection system, a post-injection system or the like is provided together with a main injection system. In the piping structure of the invention, since it is unnecessary to sag intermediate portions of the injection pipes nor to form the injection pipes in a shape being complicatedly bent in order to adjust the length of the fuel injection pipes, productivity and reliability can be enhanced.

In the piping structure of fuel injection pipes for an engine, it is possible to allow a plurality of the injection pipes to have the same length or substantially the same length. In this case, the irregularities in the amount of fuel injection can be reduced and the engine performance can be enhanced by allowing each of the fuel injection pipes to have the same length or substantially the same length. Great effect can be obtained especially when this piping structure is applied to a multi-injection system in which a pilot injection system, a pre-injection system, a post-injection system or the like is provided together with a main injection system.

DESCRIPTION OF THE PREFERRED EMBODIMENT

The present invention will be explained below with reference to the drawings.

Figure 1:
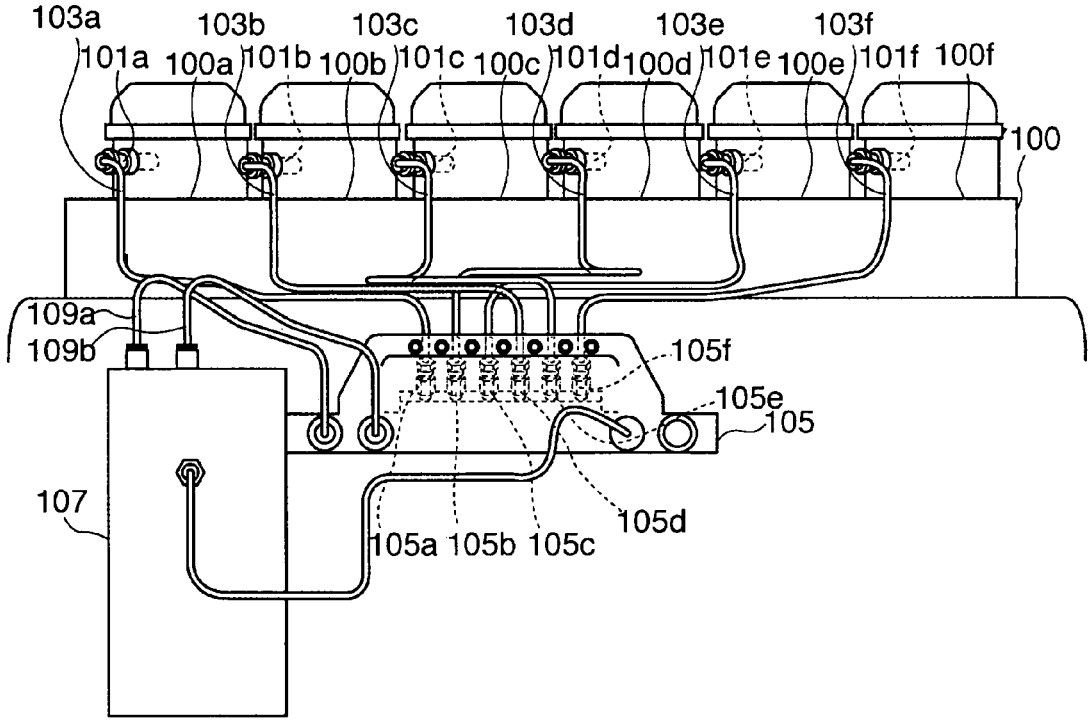
FIG. 1 is a plan view showing a piping structure (piping structure of a common rail type) of fuel injection pipes according to an aspect of a first embodiment of the present invention.

FIG. 1 is a plan view showing a piping structure (piping structure of a common rail type) of fuel injection pipes according to the aspect of the first embodiment of the present invention.

Figure 2A:
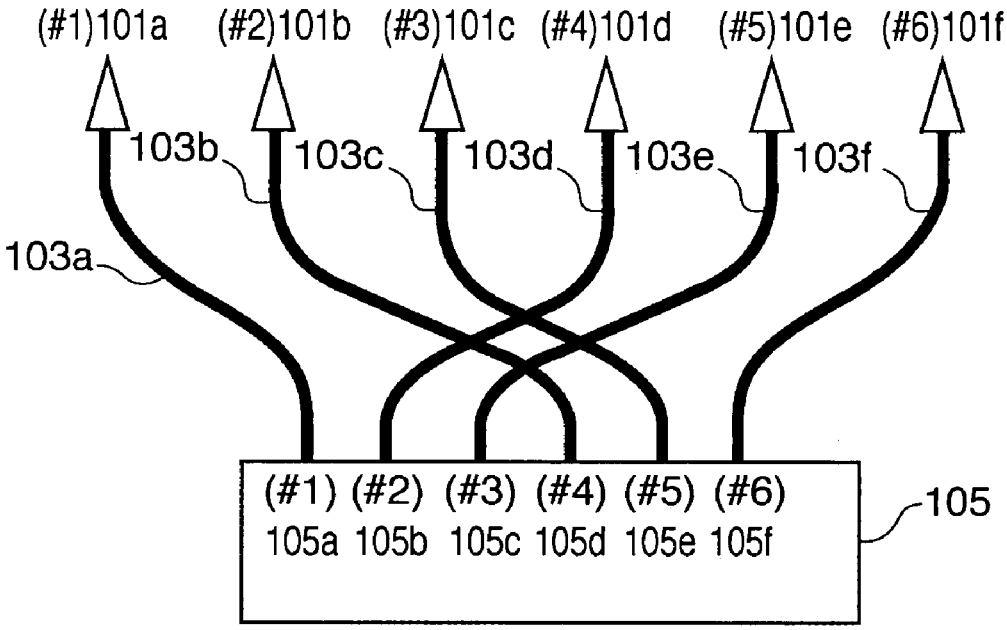
FIG. 2(A) is a pattern diagram showing a piping structure of a six-cylinder engine according to an aspect of the embodiment.
Figure 2B:
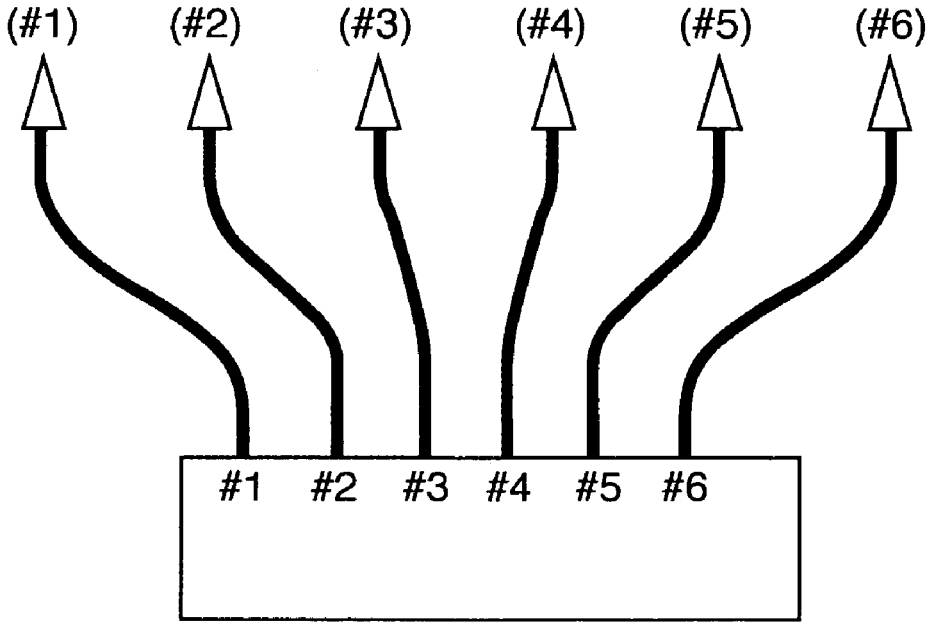
FIG. 2(B) is a pattern diagram showing a piping structure of a conventional six-cylinder engine.

FIG. 2 (A) is a pattern diagram showing a piping structure of a six-cylinder engine according to the aspect of the embodiment, and FIG. 2(B) is a pattern diagram showing a piping structure of a conventional six-cylinder engine.

FIG. 1 shows cylinder heads 100 having six cylinders. The cylinder heads 100*a* to 100*f* are respectively provided with fuel injectors (injection valves) 101*a* to 101*f*. Each tip end of the fuel injectors 101*a* to 101*f* is an injection nozzle.

Each of the fuel injectors 101*a* to 101*f* is connected to each of joints with nuts 105*a* to 105*f* (simply referred as joints, hereinafter) in common rail 105 extending linearly through fuel injection pipes 103*a* to 103*f*. The common rail 105 is connected to a fuel pump 107. Two fuel supply pipes 109*a* and 109*b* extend from the fuel pump 107. The fuel pump 107 is connected to the common rail 105 through the fuel supply pipes 109*a* and 109*b*.

Each end portion of the fuel injection pipes 103*a* to 103*f* is inserted into each of the joints 105*a* to 105*f* to be connected in the common rail 105 and then is fastened with nuts. Each of the joints 105*a* to 105*f* in the common rail 105 serves as fuel exits through which fuel is discharged. As shown in FIGS. 1 and 2(A), each of the fuel injectors 101*a* to 101*f* and each of the joints 105*a* to 105*f* in the common rail 105 are connected via the fuel injection pipes 103*a* to 103*f* according to following relation (1) to (6):

(1) The first fuel injector 101*a* from the left in the drawing is connected to the first joint 105*a* from the left in the drawing via the fuel injection pipe 103*a*.

(2) The second fuel injector 101*b* from the left in the drawing is connected to the fourth joint 105*d* from the left in the drawing via the fuel injection pipe 103*b*.

(3) The third fuel injector 101*c* from the left in the drawing is connected to the fifth joint 105*e* from the left in the drawing via the fuel injection pipe 103*c*.

(4) The fourth fuel injector 101*d* from the left in the drawing is connected to the second joint 105*b* from the left in the drawing via the fuel injection pipe 103*d*.

(5) The fifth fuel injector 101*e* from the left in the drawing is connected to the third joint 105*c* from the left in the drawing via the fuel injection pipe 103*e*.

(6) The sixth fuel injector 101*f* from the left in the drawing is connected to the sixth joint 105*f* from the left in the drawing via the fuel injection pipe 103*f*.

In this embodiment, as in the relation (2) to (5), it can be achieved to allow all the fuel injection pipes 103*a* to 103*f* to have the same length by crossing the injection pipes 103*b*, 103*c*, 103*d* and 103*e* to connect. On the contrary, as shown in FIG. 2(B), if the fuel injection pipes are not made to be crossed and the fuel injectors and the joints (fuel exits) of the common rail are connected to each other in the order of #1 to #6 (as in a general conventional piping structure), it can not be easily achieved to allow all the fuel injection pipes to have the same length.

One example of numeric values will be given. In the case of FIG. 2(A) of the embodiment, it was possible that all the fuel injection pipes were made to have the same length of 701.0 mm, while in the conventional case shown in FIG. 2(B), the lengths of #1 and #6 fuel injection pipes were 691.0 mm, the lengths of #2 and #5 fuel injection pipes were 576.5 mm, the lengths of #3 and #4 fuel injection pipes were 442.0 mm, and irregularities in a range of 1 to 1.56 times were found.

As described above, according to the aspect of the embodiment, it is possible to reduce the irregularities in the amount of fuel injection and to enhance the engine performance by achieving the fuel injection pipes 103*a* to 103*f* having the same length. Great effect can be obtained especially when this piping structure is applied to a multi-injection system in which a pilot injection system, a pre-injection system, a post-injection system or the like is provided together with a main injection system. In this aspect of the embodiment, since it is unnecessary to sag intermediate portions of the injection pipes or to form the injection pipes into a shape that is complicatedly bent, as compared with the patent document 1 described above, productivity and reliability can be enhanced.

Next, an aspect of a second embodiment of the present invention will be explained.

Figure 3:
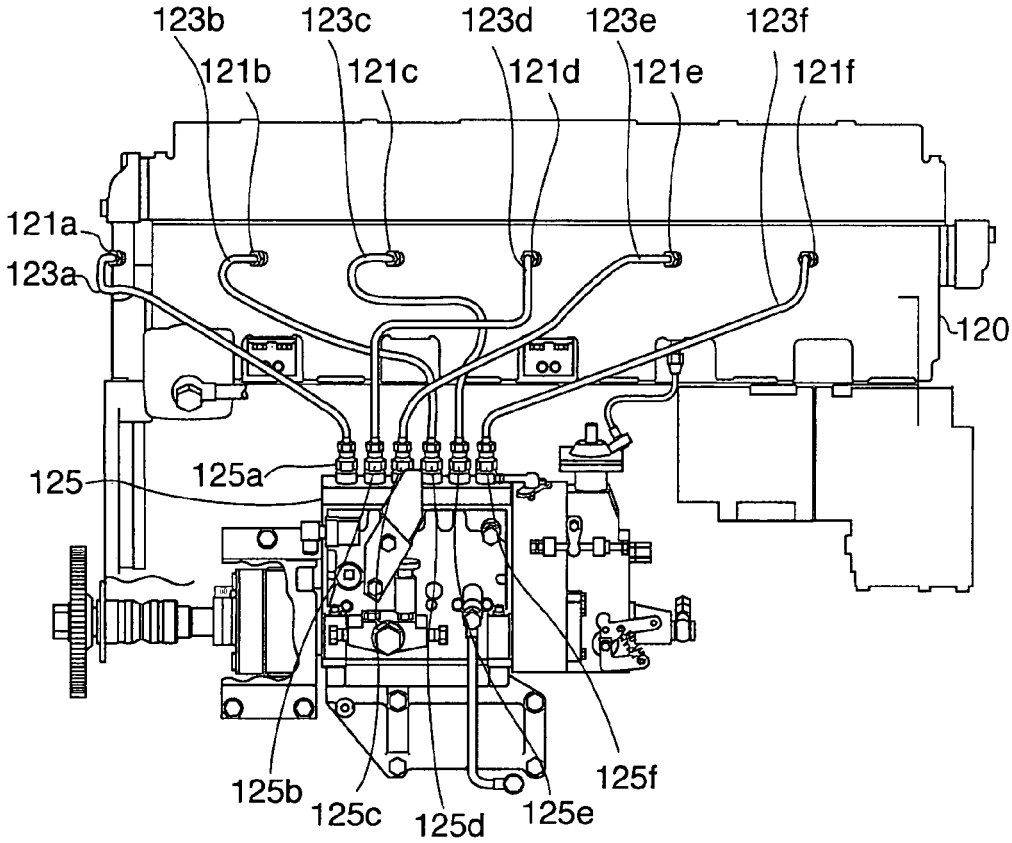
FIG. 3 is a plan view showing a piping structure (piping structure of an in-line pump type) of fuel injection pipes according to an aspect of a second embodiment of the invention.

FIG. 3 is a plan view showing a piping structure (piping structure of an in-line pump type) of fuel injection pipes according to the aspect of the second embodiment of the invention.

FIG. 3 shows cylinder heads 120 having six cylinders. The cylinder heads 120 respectively includes fuel injectors (injectors) 121*a* to 121*f*. Each tip end of the fuel injectors 121*a* to 121*f* is an injection nozzle. Each of the fuel injectors 121*a* to 121*f* is connected to each of joints (fuel exits) 125*a* to 125*f* of an in-line pump 125 having individual pumps through fuel injection pipes 123*a* to 123*f*. Each end of the fuel injection pipes 123*a* to 123*f* is inserted into each of the joints 125*a* to 125*f* in the in-line pump 125 to be connected and then is fastened with nuts.

In the piping structure of this second embodiment as well, with the same relation with (1) to (6) described above (see FIG. 2(A)), it can be achieved to allow all the fuel injection pipes 123*a* to 123*f* to have the same length by crossing the injection pipes 123*b*, 123*c*, 123*d* and 123*e* to connect. Thus, in this case as well, it is possible to reduce the irregularities in the amount of fuel injection and to enhance the engine performance.

Next, examples of the piping structure of the fuel injection pipes with respect to four-cylinder, six-cylinder and eight-cylinder engines will be explained.

Figure 5A:
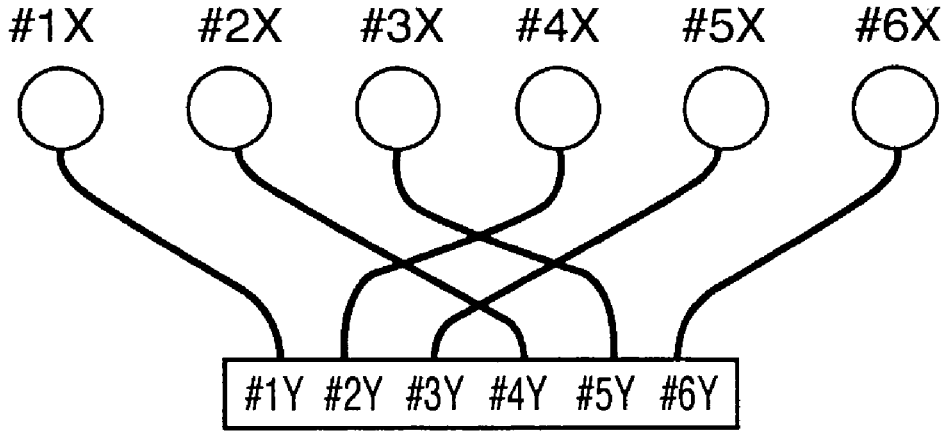
FIGS. 5A and 5B are pattern diagrams showing examples of fuel injection pipes with respect to a six-cylinder engine.
Figure 5B:
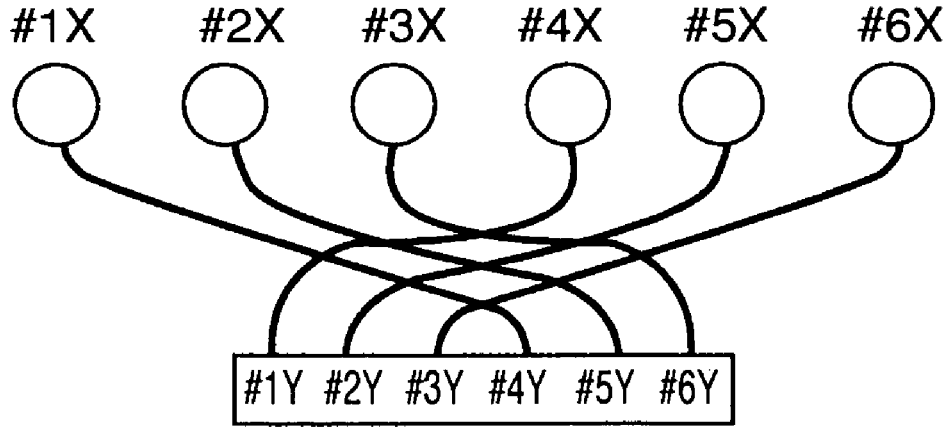
Figure 6A:
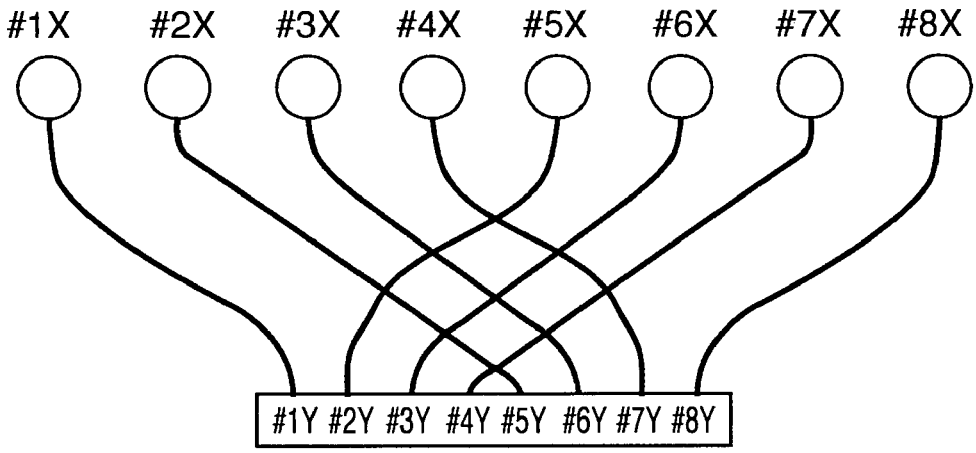
FIGS. 6A and 6B are pattern diagrams showing examples of fuel injection pipes with respect to an eight-cylinder engine.
Figure 6B:
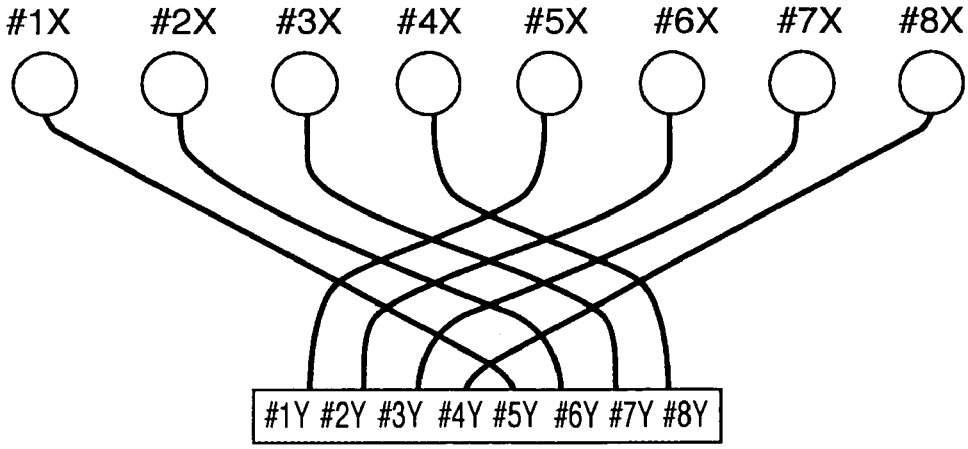
Figure 7:
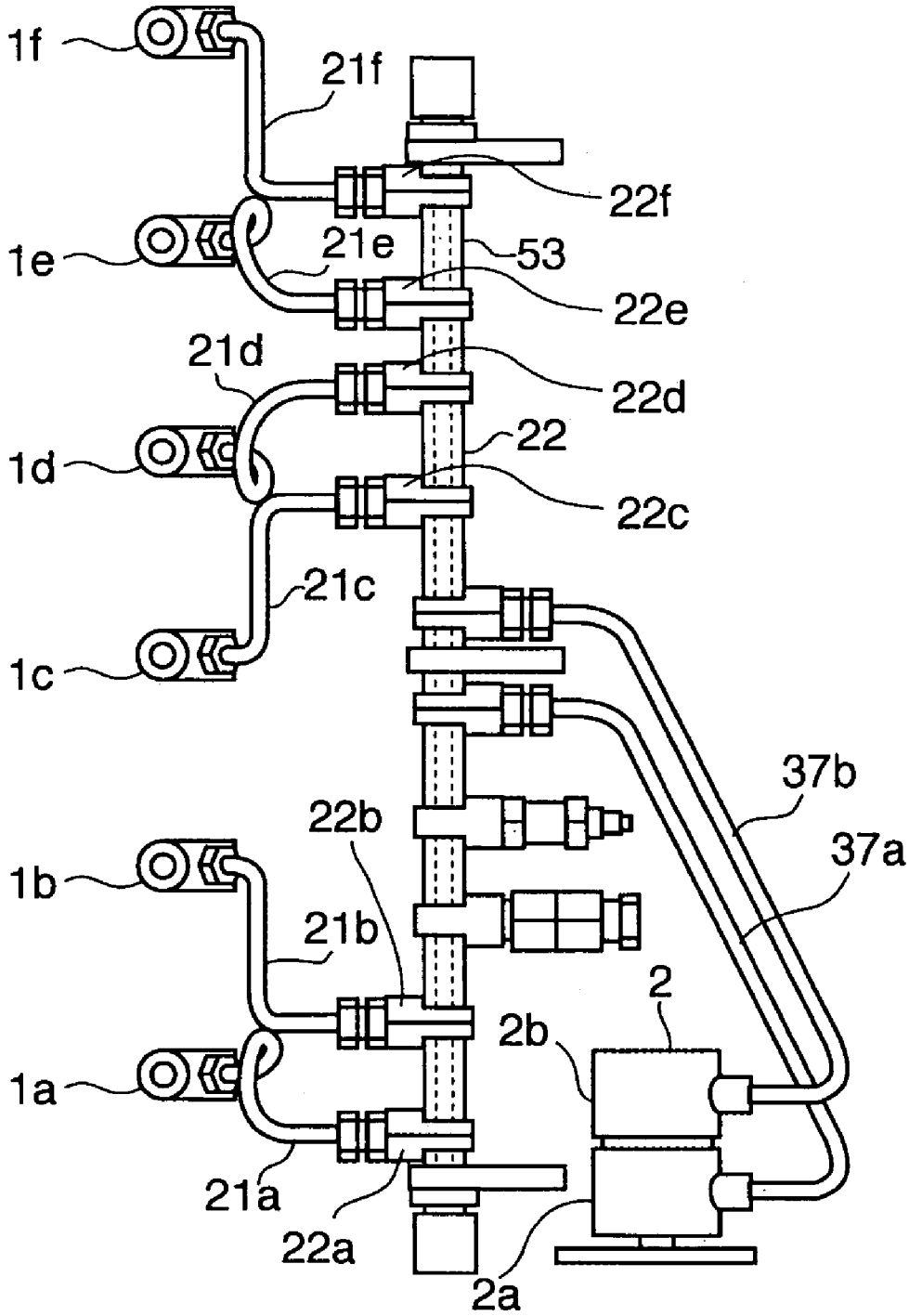
FIG. 7 is a plan view of a fuel injection device disclosed in the patent document 1.

FIGS. 4, 5 and 6 are pattern diagrams respectively showing examples of the piping structure of fuel injection pipes of the four-cylinder, six-cylinder and eight-cylinder engines. In each of these drawings, ○ (circle) in the upper side represents the fuel injectors and □ (rectangle) in the lower side represents the common rail or in-line pump, and thick lines therebetween represent fuel injection pipes. Numbers are arranged from the left in order, symbols X are added to the ends of the numbers of the fuel injectors represented by ○, and symbols Y are added to the ends of the numbers of the fuel exits of the common rail or tandem pumps represented by □, thereby distinguishing the fuel injectors and common rail or in-line pumps.

Figure 4A:
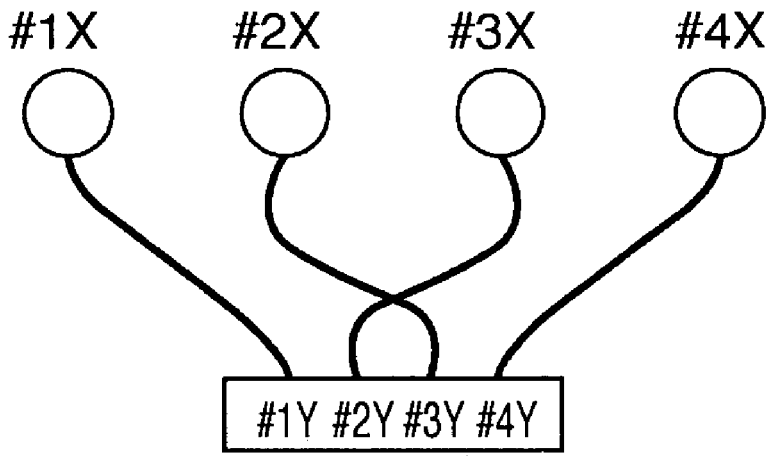
FIGS. 4A and 4B are pattern diagrams showing examples of fuel injection pipes with respect to a four-cylinder engine.
Figure 4B:
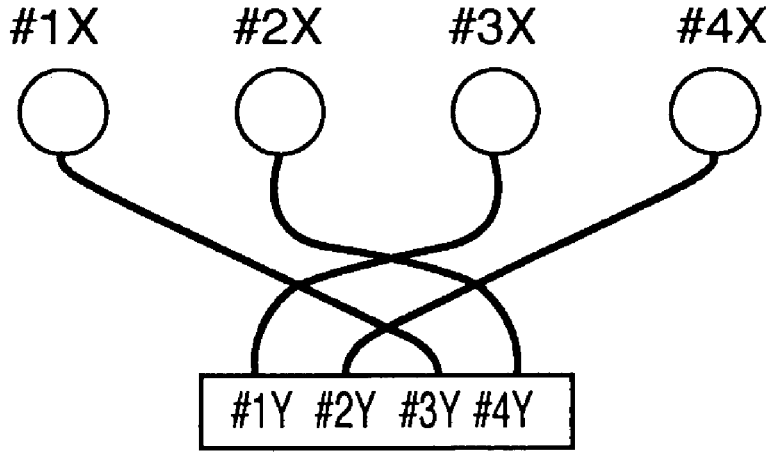

"In the case of four-cylinder engine" shown in FIG. 4(A), the pipes are arranged in accordance with the relation of #1X⇔#1Y, #2X⇔#3Y, #3X⇔#2Y, #4X⇔#4Y. In this case, two intermediate fuel injection pipes are crossing. In the case shown in FIG. 4(B), the pipes are arranged in accordance with the relation of #1X⇔#3Y, #2X⇔#4Y, #3X⇔#1Y, #4X⇔#2Y. In this case, four fuel injection pipes are crossing.

"In the case of six-cylinder engine" shown in FIG. 5(A), the pipes are arranged in accordance with the relation of 1IX⇔1IY, #2X⇔#4Y, #3X⇔#5Y, #4X⇔#2Y, #5Xp⇔3βY, #6X⇔#6Y. This case is the same as shown in FIG. 2(A), and four intermediate fuel injection pipes are crossing.

In the case shown in FIG. 5(B), the pipes are arranged in accordance with the relation of #1X⇔#4Y, #2X⇔#5Y, #3X⇔#6Y, #4X⇔#1Y, #5X⇔#2Y, #6X⇔#3Y. In this case, six fuel injection pipes are crossing.

"In the case of eight-cylinder engine" shown in FIG. 6(A), the pipes are arranged in accordance with the relation of #1X⇔#1Y, #2X⇔#5Y, #3X⇔#6Y, #4X⇔#7Y, #5X⇔#2Y, #6X⇔#3Y, #7X⇔#4Y, #8X⇔#8Y. In this case, six intermediate fuel injection pipes are crossing. In the case shown in FIG. 6 (B), the pipes are arranged in accordance with the relation of #1X⇔#5Y, #2X⇔#6Y, #3X⇔#7Y, #4X⇔#8Y, #5X⇔1Y, #6X⇔#2Y, #7X⇔#3Y, #8X⇔#4Y. In this case, eight fuel injection pipes are crossing.

If all or some of the fuel injection pipes are crossed to allow the pipes to have the same length other than those shown in FIGS. 4 to 6, other examples of the piping structure can be employed.

As apparent from the above explanation, the present invention can provide a piping structure of fuel injection pipes for an engine having advantages that irregularities in the amount of fuel injection are reduced to enhance engine performance and productivity and reliability of the piping structure can be enhanced.

What is claimed is:

1. A fuel injection piping structure for an engine including a plurality of cylinders disposed in a line, a plurality of fuel injectors connected to the plurality of cylinders, respectively, a fuel accumulator for delivering fuel to the fuel injectors, the fuel accumulator having a plurality of fuel exit holes arranged along a longitudinal direction of the fuel accumulator, said piping structure comprising:

a plurality of fuel injection pipes extending between the fuel injectors and the fuel exit holes of the fuel accumulator, wherein each of the fuel injection pipes is connected to one of the fuel injectors and one of the plurality of fuel exit holes of the fuel accumulator; and at least two of the fuel injection pipes are arranged so as to cross each other.

2. A fuel injection piping structure for an engine including a plurality of cylinders disposed in a line, a plurality of fuel injectors connected to a plurality of cylinders, respectively, and an in-line pump having a plurality of individual pumps disposed in a line for pressurizing fuel to be delivered to the fuel injectors, respectively, said piping structure comprising:

a plurality of pipes extending between the fuel injectors and the individual pumps of the in-line pump, wherein each of the fuel injection pipes is connected to one of the fuel injectors and one of the individual pumps of the in-line pump, and at least two of the fuel injection pipes are arranged so as to cross each other.

3. The fuel injection piping structure according to claim 1, wherein the plurality of the injection pipes have the same length or substantially the same length.

4. The fuel injection piping structure according to claim 2, wherein the plurality of the injection pipes have the same length or substantially the same length.

5. The fuel injection piping structure according to claim 1, wherein the number of injection pipes is four, and at least the two intermediate of the injection pipes cross each other.

6. The fuel injection piping structure according to claim 2, wherein the number of injection pipes is four, and at least the two intermediate of the injection pipes cross each other.

7. The fuel injection piping structure according to claim 1, wherein the plurality of cylinders comprises at least six cylinders, the plurality of fuel injectors comprises at least six fuel injectors, the plurality of fuel exit holes comprises at least six fuel exit holes, and the plurality of pipes comprises at least six pipes, wherein the six cylinders are numbered first through sixth in a direction from left to right, and the six fuel exit holes are numbered first through sixth in a direction from left to right, the first pipe is connected between the number one fuel exit hole and the number one fuel injector;

the second pipe is connected between the number two fuel exit hole and the number four fuel injector;

the third pipe is connected between the number three fuel exit hole and the number five fuel injector;

the fourth pipe is connected between the number four fuel exit hole and the number two fuel injector;

the fifth pipe is connected between the number five fuel exit hole and the number three fuel injector; and the sixth pipe is connected between the number six fuel exit hole and the number six fuel injector.

8. The fuel injection piping structure according to claim 1, wherein the plurality of cylinders comprises at least six cylinders, the plurality of fuel injectors comprises at least six fuel injectors, the plurality of fuel exit holes comprises at least six fuel exit holes, and the plurality of pipes comprises at least six pipes, wherein the six cylinders are numbered first through sixth in a direction from left to right, and the six fuel exit holes are numbered first through sixth in a direction from left to right, the first pipe is connected between the number one fuel exit hole and the number four fuel injector;

the second pipe is connected between the number two fuel exit hole and the number five fuel injector;

the third pipe is connected between the number three fuel exit hole and the number six fuel injector;

the fourth pipe is connected between the number four fuel exit hole and the number one fuel injector;

the fifth pipe is connected between the number five fuel exit hole and the number two fuel injector; and the sixth pipe is connected between the number six fuel exit hole and the number three fuel injector.

9. The fuel injection piping structure according to claim 2, wherein the plurality of cylinders comprises at least six cylinders, the plurality of fuel injectors comprises at least six fuel injectors, the plurality of individual pumps comprises at least six individual pumps, and the plurality of pipes comprises at least six pipes, wherein the six cylinders are numbered first through sixth in a direction from left to right, and the six individual pumps are numbered first through sixth in a direction from left to right, the first pipe is connected between the number one individual pump and the number one fuel injector;

the second pipe is connected between the number two individual pump and the number four fuel injector;

the third pipe is connected between the number three individual pump and the number five fuel injector;

the fourth pipe is connected between the number four individual pump and the number two fuel injector;

the fifth pipe is connected between the number five individual pump and the number three fuel injector; and the sixth pipe is connected between the number six individual pump and the number six fuel injector.

10. The fuel injection piping structure according to claim 2, wherein the plurality of cylinders comprises at least six cylinders, the plurality of fuel injectors comprises at least six fuel injectors, the plurality of individual pumps comprises at least six individual pumps, and the plurality of pipes comprises at least six pipes, wherein the six cylinders are numbered first through sixth in a direction from left to right, and the six individual pumps are numbered first through sixth in a direction from left to right, the first pipe is connected between the number one individual pump and the number four fuel injector;

the second pipe is connected between the number two individual pump and the number five fuel injector;

the third pipe is connected between the number three individual pump and the number six fuel injector;

the fourth pipe is connected between the number four individual pump and the number one fuel injector;

the fifth pipe is connected between the number five individual pump and the number two fuel injector; and the sixth pipe is connected between the number six individual pump and the number three fuel injector.

11. The fuel injection piping structure according to claim 1, wherein the plurality of cylinders comprises at least eight cylinders, the plurality of fuel injectors comprises at least eight fuel injectors, the plurality of fuel exit holes comprises at least eight fuel exit holes, and the plurality of pipes comprises at least eight pipes, wherein the eight cylinders are numbered first through eighth in a direction from left to right, and the eight fuel exit holes are numbered first through eighth in a direction from left to right, the first pipe is connected between the number one fuel exit hole and the number one fuel injector;

the second pipe is connected between the number two fuel exit hole and the number five fuel injector;

the third pipe is connected between the number three fuel exit hole and the number six fuel injector;

the fourth pipe is connected between the number four fuel exit hole and the number seven fuel injector;

the fifth pipe is connected between the number five fuel exit hole and the number two fuel injector;

the sixth pipe is connected between the number six fuel exit hole and the number three fuel injector;

the seventh pipe is connected between the number seven fuel exit hole and the number four fuel injector; and the eighth pipe is connected between the number eight fuel exit hole and the number eight fuel injector.

12. The fuel injection piping structure according to claim 1, wherein the plurality of cylinders comprises at least eight cylinders, the plurality of fuel injectors comprises at least eight fuel injectors, the plurality of fuel exit holes comprises at least eight fuel exit holes, and the plurality of pipes comprises at least eight pipes, wherein the eight cylinders are numbered first through eighth in a direction from left to right, and the eight fuel exit holes are numbered first through eighth in a direction from left to right, the first pipe is connected between the number one fuel exit hole and the number five fuel injector;

the second pipe is connected between the number two fuel exit hole and the number six fuel injector;

the third pipe is connected between the number three fuel exit hole and the number seven fuel injector;

the fourth pipe is connected between the number four fuel exit hole and the number eight fuel injector;

the fifth pipe is connected between the number five fuel exit hole and the number one fuel injector;

the sixth pipe is connected between the number six fuel exit hole and the number two fuel injector;

the seventh pipe is connected between the number seven fuel exit hole and the number three fuel injector; and the eighth pipe is connected between the number eight fuel exit hole and the number four fuel injector.

13. The fuel injection piping structure according to claim 2, wherein the plurality of cylinders comprises at least eight cylinders, the plurality of fuel injectors comprises at least eight fuel injectors, the plurality of individual pumps comprises at least eight individual pumps, and the plurality of pipes comprises at least eight pipes, wherein the eight cylinders are numbered first through eighth in a direction from left to right, and the eight individual pumps are numbered first through eighth in a direction from left to right, the first pipe is connected between the number one individual pump and the number one fuel injector;

the second pipe is connected between the number two individual pump and the number five fuel injector;

the third pipe is connected between the number three individual pump and the number six fuel injector;

the fourth pipe is connected between the number four individual pump and the number seven fuel injector;

the fifth pipe is connected between the number five individual pump and the number two fuel injector;

the sixth pipe is connected between the number six individual pump and the number three fuel injector;

the seventh pipe is connected between the number seven individual pump and the number four fuel injector; and the eighth pipe is connected between the number eight individual pump and the number eight fuel injector.

14. The fuel injection piping structure according to claim 2, wherein the plurality of cylinders comprises at least eight cylinders, the plurality of fuel injectors comprises at least eight fuel injectors, the plurality of individual pumps comprises at least eight individual pumps, and the plurality of pipes comprises at least eight pipes, wherein the eight cylinders are numbered first through eighth in a direction from left to right, and the eight individual pumps are numbered first through eighth in a direction from left to right, the first pipe is connected between the number one individual pump and the number five fuel injector;

the second pipe is connected between the number two individual pump and the number six fuel injector;

the third pipe is connected between the number three individual pump and the number seven fuel injector;

the fourth pipe is connected between the number four individual pump and the number eight fuel injector;

the fifth pipe is connected between the number five individual pump and the number one fuel injector;

the sixth pipe is connected between the number six individual pump and the number two fuel injector;

the seventh pipe is connected between the number seven individual pump and the number three fuel injector; and the eighth pipe is connected between the number eight individual pump and the number four fuel injector.

* * * * *